US005478264A

United States Patent [19]

Law

[11] Patent Number: 5,478,264

[45] Date of Patent: Dec. 26, 1995

[54] MARINE ENGINE MOUNTING SYSTEM

[75] Inventor: Roy M. Law, W. Bloomfield, Mich.

[73] Assignee: Detroit Diesel Corporation, Detroit, Mich.

[21] Appl. No.: 341,353

[22] Filed: Nov. 17, 1994

[51] Int. Cl.[6] ..... B63H 21/30

[52] U.S. Cl. ..... 440/111; 248/637

[58] Field of Search ..... 440/52, 111, 112; 180/299, 300, 312; 248/637, 671, 674, 678

[56] References Cited

U.S. PATENT DOCUMENTS 4,678,439 7/1987 Schlichthorst ..... 440/111
4,778,421 10/1988 Greenberg ..... 440/111

FOREIGN PATENT DOCUMENTS 3938141 5/1991 Germany ..... 440/111

*Primary Examiner*—Jesus D. Sotelo
*Attorney, Agent, or Firm*—Brooks & Kushman

[57] ABSTRACT

A vibration absorbing assembly for mounting a marine engine to a stringer is provided, including: a mounting bracket adapted for attachment to the marine engine; a base adapted for attachment to a stringer; and first and second resilient vibration absorbing members supported within the mounting bracket and selectively connected to the base, the first resilient member being relatively more resistant in a horizontal direction for cushioning horizontal thrust loads acting upon the bracket with respect to the base, the first resilient member providing substantially zero resistance to vertical movement of the bracket with respect to the base when no horizontal thrust load is acting upon the bracket with respect to the base, and the second resilient member being relatively more resistant in a vertical direction for cushioning vertical loads upon the bracket with respect to the base. Also provided is a three point marine engine and marine gear mounting assembly, including the above described vibration absorbing assembly.

5 Claims, 2 Drawing Sheets

MARINE ENGINE MOUNTING SYSTEM

FIELD OF INVENTION

This invention relates generally to supports, and more particularly to vibration absorbing mounting systems for marine engines.

BACKGROUND ART

Formerly, inboard marine propulsion devices employing horizontally mounted engines had their motor supports or bases secured directly to the hull of the boat. The motor supports were usually attached at four or more points to the boat. As a result, much of the vibration and noise generated in the engines and propulsion devices was transmitted to the boat with consequent unpleasant effects. This problem was partially addressed by the development of three point mounting systems. These three point mounting systems were instrumental in helping to isolate engine vibration.

However, three point systems have not fully solved the problem of engine vibration. Furthermore, to date, a mount has not been developed which is sufficiently soft to absorb engine vibration at idle, while being sufficiently stiff to support additive loads and vibrations when a horizontal thrust propulsion load is present.

In prior art systems it is commonly known to mount the marine engine on a three point suspension assembly, the assembly being disposed about the engine roll axis, to support the engine with respect to the stringers. Rubber isolators are commonly provided at each suspension point to absorb vibration of the engine.

Generally, in the prior art, the marine gear is mounted to the engine by means of a drive shaft. The marine gear is connected to the propeller shaft, and moves generally independently of the engine. Accordingly, the thrust of the propeller is absorbed by the marine gear mounting system. However, new packaging designs have required that the marine gear be mounted to and move with the marine engine. In this configuration, the marine engine and marine gear assembly are subject to the thrust forces from the propeller which were previously absorbed by the marine gear mounting system.

A unique problem occurs when a thrust load is imposed directly upon the engine. Even where resilient grommets or sleeves have been provided around mounting bolts to prevent direct contact thereof with the frame or engine, such mounts are unsatisfactory. The high thrust loads from the propeller shaft caused rapid deterioration of such grommets resulting in early failure. This deterioration permits direct metal-to-metal contact and direct transmission of vibration and sound from the engine support structure to the hull of the boat. Such sound and vibrations travel throughout the ship's hull and can become magnified. Such vibrations can have a detrimental effect of the ship's structure and equipment. In addition, vibrations within the audible range can be disturbing to passengers.

Accordingly, it would be desirable to develop an engine mounting system which would absorb the horizontal propeller thrust forces while simultaneously providing sufficient vertical support to the engine to support the engine weight and compensate for engine roll due to torque. Presently, no such mounting system is available which absorbs horizontal thrust and vertical vibration within a single mounting bracket housing.

Accordingly, an object of the present invention is develop a marine engine and marine gear mounting system which solves the above mentioned problems faced by the prior art systems.

A further object of the present invention is to provide a single mounting bracket which is capable of absorbing horizontal thrust loads and vertical engine loads simultaneously.

Accordingly, the present invention provides a vibration absorbing assembly for mounting a marine engine to a stringer, comprising: a mounting bracket adapted for attachment to the marine engine; a base adapted for attachment to the stringer; and first and second resilient vibration absorbing members supported within the mounting bracket and selectively connected to said base, the first resilient member being relatively more yieldable in a horizontal direction for cushioning horizontal thrust loads acting upon the bracket with respect to said base, the first resilient member providing substantially zero resistance to vertical movement of the bracket with respect to said base when no horizontal thrust load is acting upon the bracket with respect to said base, and the second resilient member being relatively more yieldable in a vertical direction for cushioning vertical loads upon the bracket with respect to said base.

Also provided is a vibration isolating system for a marine engine and drive gear assembly to be mounted upon a pair of longitudinally extending, generally parallel stringers, comprising: a trunnion mount for mounting the front of the engine to the crossmember; and a pair of vibration absorbing assemblies, each assembly configured for mounting the rear of the engine and marine gear to the respective stringer, each assembly including: a mounting bracket adapted for attachment to the engine; a base adapted for attachment to a stringer and first and second resilient vibration absorbing members supported within the mounting bracket and selectively connected to said base, the first resilient member being relatively more yieldable in a horizontal direction for cushioning horizontal thrust loads acting upon the bracket with respect to said base, the first resilient member providing substantially zero resistance to vertical movement of the bracket with respect to said base when no horizontal thrust load is acting upon the bracket with respect to said base, and the second resilient member being relatively more yieldable in a vertical direction for cushioning vertical loads upon the bracket with respect to said base.

DETAILED DESCRIPTION OF THE PREFERRED EMBODIMENT

Figure 1:
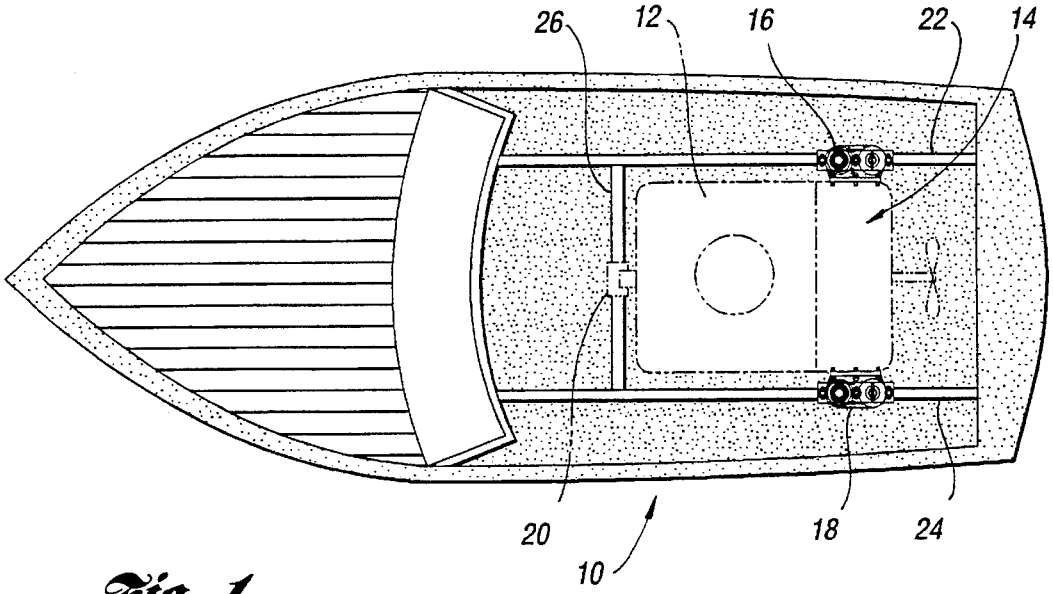
FIG. 1 shows a schematic environmental view of an engine and marine gear assembly mounting system located within a boat.

Referring to FIG. 1, a marine engine and marine gear assembly mounting system 10 is shown in accordance with the present invention. A marine engine 12 and marine gear 14 are mounted to the boat by means of vibration absorbing mounting assemblies 16,18 and a trunnion mount 20. The vibration absorbing assemblies 16,18 connect the marine engine and marine gear to the stringers 22,24, which ran longitudinally along the hull of the boat. The front of the engine 12 is supported with respect to the crossmember 26 by the trunnion mount 20. This three point mounting system is capable of absorbing propeller thrust loads, engine weight, vibration and additive vertical loads resulting from engine roll and torque.

Figure 2:
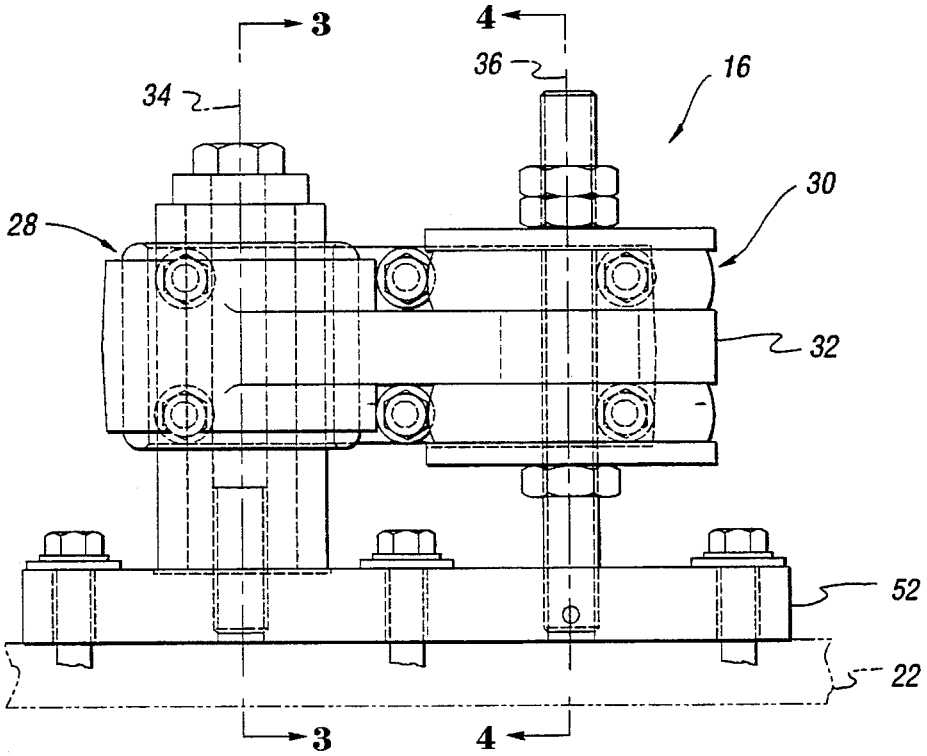
FIG. 2 shows a side view of a rear mount assembly with a thrust isolator and a vertical load isolator in accordance with the present invention.

The vibration absorbing assemblies 16,18 are configured to absorb both thrust and vertical loads acting upon the engine. FIG. 2 shows a side view of one such vibration absorbing assembly 16 in accordance with the present invention. The vibration absorbing assembly 16 is attached to the stringer 22. The thrust isolator 28 and vertical load isolator 30 are in a side-by-side relationship and share a common mounting bracket 32. The thrust and vertical load isolators 28,30 are disposed along parallel axes 34,36, and are connected to the base 52 which is attached to the stringer 22.

Figure 3:
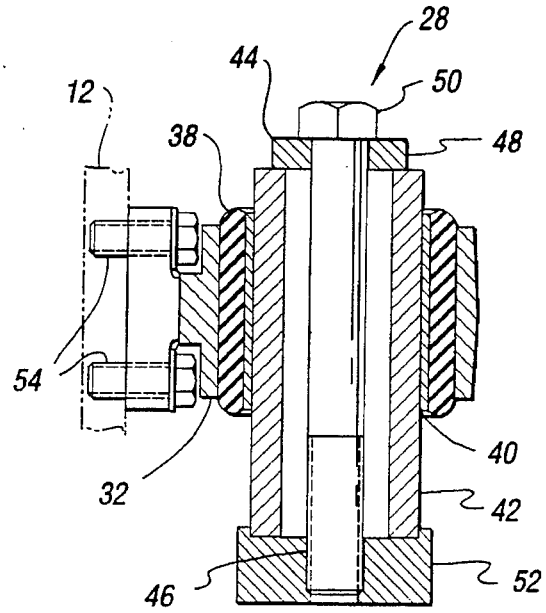
FIG. 3 shows a vertical cross-section of a thrust isolator in accordance with the present invention.

Referring to FIG. 3, a vertical cross-section of a thrust isolator 28 is shown in accordance with the present invention. The mounting bracket 32 is rigidly connected to the engine 12 by means of the mounting bolts 54. A first rubber isolator 38 is pressed into a cylindrical opening in the bracket 32. The first rubber isolator 38 has a first steel sleeve 40 bonded therewith in a cylindrical opening formed therein. The first steel sleeve 40 and first rubber isolator 38 are disposed about a hollow thrust post 42. A nominal diametrical 0.060 clearance exists between the first metal sleeve 40 and the hollow thrust post 42 when no horizontal thrust load is present. Using this configuration, the mounting bracket 32 is allowed to move with the vertical load isolator 30 without frictional resistance between the first steel sleeve 40 and the hollow thrust post 42 when no horizontal thrust load is present due to the nominal diametrical 0.060" gap between the first steel sleeve 40 and the hollow thrust post 42. A first isolator bolt 44 rigidly mounts the hollow thrust post 42 to the base 52 by means of the threaded connection 46. A first washer 48 is positioned between the bolt head 50 and the top of the hollow thrust post 42.

Figure 4:
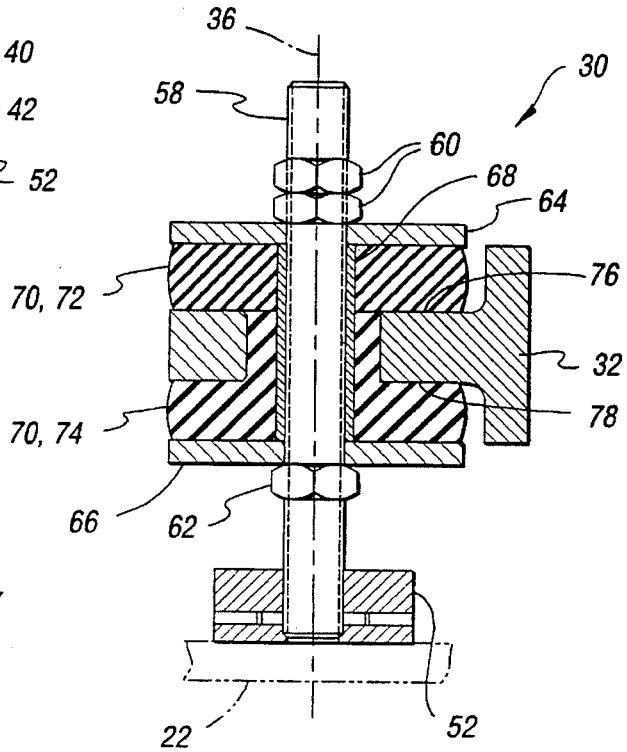
FIG. 4 shows a vertical cross-section of a vertical load isolator in accordance with the present invention.

Referring now to FIG. 4, a second isolator bolt 58 is disposed along the second axis 36 and is connected to the base 52. The base 52 is mounted to the stringer 22. Upper and lower nuts 60,62 are disposed along the second isolator bolt 58. These nuts 60,62 hold the second and third washers 64,66 against the second metal sleeve 68. A second rubber isolator 70 is bonded to the second metal sleeve 68. The second rubber isolator 70 is a two-piece member including first and second radially extending portions 72,74 as separate members, and with one of these members, i.e. member 72 including a cylindrical hub portion filling the cylindrical opening in bracket 32. The first radially extending portion 72 of the second rubber isolator 70 is positioned between the second washer 64 and the first surface 76 of the mounting bracket 32. The second radially extending portion 74 of the isolator 70 is positioned between the second surface 78 of the mounting bracket 32 and the third washer 66. Using this configuration, the second and third washers 64,66 are tightened against the second rubber isolator 70 by tightening the nuts 60,62. This tightening creates a preload upon the second rubber isolator 70. The second metal sleeve 68 limits the movement of the second and third washers in order to set the preload placed upon the second rubber isolator 70. The second rubber isolator 70 resists vertical loads upon the mounting bracket 32 with respect to the base 52. The second rubber isolator 70 is of sufficient hardness to absorb engine vibration at idle, while being of sufficient hardness to resist heavy loads resulting from additive forces of engine weight, engine roll due to torque and engine vibrations to provide accurate vertical engine positioning within the boat. The vertical load isolator 30 is configured to absorb a substantial portion of vertical loads and vibrations of the engine with respect to the stringers. The rubber isolators are preferably having 45–70 durometer.

Figure 5:
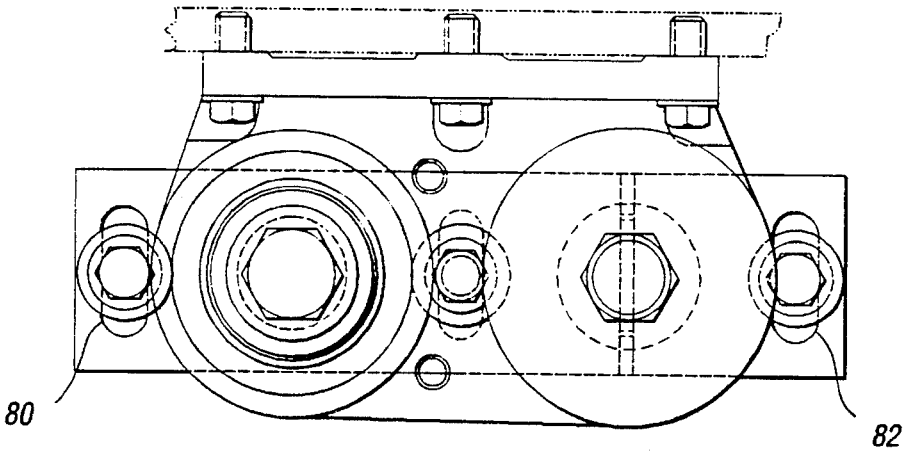
FIG. 5 shows a top view of a rear mount assembly with a thrust isolator and a vertical load isolator in accordance with the present invention.

Referring to FIG. 5, the slots 80,82 provide room for horizontal adjustment for different sizes and configurations of engines and alignment of the engine and marine gear with respect to the propeller drive shaft. Similarly, as shown in FIG. 4, the nuts 60,62 provide room for threaded adjustment for different heights and alignment of drive components.

In operation, when the engine is at idle, substantially zero horizontal thrust load is present. When no thrust load is present, the nominal diametrical 0.060" clearance between the first metal sleeve 40 and the hollow thrust post 42 allows the bracket 32 to move with respect to the base 52. Therefore, at idle, substantially all vertical vibrations and vertical loads are resisted by the vertical load isolator 30.

When the engine is running in gear, i.e. forward or reverse, a horizontal thrust load is present, thereby causing the first metal sleeve 40 to engage the hollow thrust post 42. The friction therebetween will resist movement of the first metal sleeve 40 with respect to the hollow thrust post 42 thereby assisting in absorbing rotational torque loads on the engine. Also, since the first rubber isolator 38 is stiff in compression and soft in shear, lateral thrust loads are resisted by the first rubber isolator 38 and transmitted to the first isolator post 42 which is attached to the base 52 with the bolt 44. When significant vertical loads are present in addition to the horizontal thrust load, the softness of the first rubber isolator 38 in shear and the second vertical isolator 70 allow for controlled vertical movement of the bracket 32 with respect to the base 52. In this manner, when a horizontal thrust load is present, vertical loads and vibrations are resisted by both the first rubber isolator 38 and the second vertical isolator 70. Vertical loads and vibrations resisted by the second rubber isolator 70 are transmitted through the second and third washers 64,66 into the second isolator bolt 58. The second isolator bolt 58 is mounted to the base 52, which in turn is mounted to the stringer 22.

This design provides substantial adjustment capability for different sizes, weights, alignments and tolerances by adjusting the nuts 60,62 for vertical adjustment, sliding the assembly horizontally within the slots 80,82 for horizontal adjustment, and by changing durometer of the first and second rubber isolators 38,70 for different thrust and vertical resiliency.

Alternatively, a cradle may connect the marine gear to the engine. The rear isolator assemblies disclosed herein would simply connect the cradle to the stringers rather than directly connecting the marine engine or marine gear to the stringers.

Referring back to FIG. 1, the front mount 20 may be a basic trunnion mount at the crank shaft or above the crankshaft to provide vertical and lateral support and to provide some flexibility in the torsional direction.

While the best mode for carrying out the invention has been described in detail, those familiar in the art to which this invention relates will recognize various alternative designs and embodiments for practicing the invention as defined by the following claims.

What is claimed is:

1. A vibration-absorbing assembly for mounting a marine engine to a stringer, comprising:

a mounting bracket adapted for attachment to the marine engine;

a base adapted for attachment to a stringer; and first and second resilient vibration absorbing members supported within said mounting bracket and selectively connected to said base, said first resilient member being relatively more resistant in a horizontal direction for cushioning horizontal thrust loads acting upon said bracket with respect to said base, said first resilient member providing substantially zero resistance to vertical movement of said bracket with respect to said base when no horizontal thrust load is acting upon said bracket with respect to said base, and said second resilient member being relatively more resistant in a vertical direction for cushioning vertical loads upon said bracket with respect to said base.

2. In combination, a marine engine and drive gear assembly and a vibration-absorbing assembly mounting an end portion of the marine engine and drive gear assembly to a stringer, comprising:

a mounting bracket attached to the end portion of the marine engine and drive gear assembly;

a base adapted for attachment to a stringer; and first and second resilient vibration absorbing members supported within said mounting bracket and selectively connected to said base, said first resilient member being relatively more resistant in a horizontal direction for cushioning horizontal thrust loads acting upon said bracket with respect to said base, said first resilient member providing substantially zero resistance to vertical movement of said bracket with respect to said base when no horizontal thrust load is acting upon said bracket with respect to said base, and said second resilient member being relatively more resistant in a vertical direction for cushioning vertical loads upon said bracket with respect to said base.

3. A vibration-isolating mount for mounting a marine engine and drive gear assembly to a stringer, comprising:

a bracket having first and second cylindrical apertures formed along substantially parallel axes therethrough, and adapted to be rigidly mounted to a marine engine and drive gear assembly, said bracket having first and second surfaces adjacent said second aperture;

a first substantially cylindrical rubber member pressed within said first aperture and sharing said first axis with said first aperture, said cylindrical rubber member having a central opening formed therethrough;

a first metal sleeve bonded within said central opening formed in said cylindrical rubber member and positioned along said first axis;

a thrust post disposed along said first axis within said first metal sleeve, and being spaced slightly inwardly within said sleeve to provide sufficient clearance therefrom to allow relative movement therebetween when no thrust load is present perpendicular to said first axis and to facilitate contact therebetween and resist rotation of the engine due to engine torque when sufficient thrust load is present, said thrust post being connected with respect to the stringer and having first and second ends thereof;

whereby said substantially cylindrical rubber member cushions horizontal thrust loads acting upon said bracket with respect to the stringer;

a support bolt disposed along said second axis at least partially within said second aperture and connected with respect to the stringer;

a pair of washers disposed about said support bolt;

a second metal sleeve disposed about said support bolt between said second and third washers; and a second rubber member disposed about said second sleeve and having first and second radially extending portions, said first portion positioned between one of said pair of washers and said first surface of said bracket, and said second portion positioned between the other of said pair of washers and said second surface of said bracket, said second rubber member being held in compression between said washers;

whereby said second rubber member cushions vertical loads acting upon said bracket with respect to the stringer.

4. The vibration-isolating mount of claim 3, further comprising:

a base connected to the stringer;

a thrust bolt disposed along said first axis within said thrust post for connecting said thrust post with respect to the base, and said thrust bolt having a head;

a first washer disposed about said thrust bolt between the head of said thrust bolt and the first end of said thrust post;

first and second nuts spaced apart and disposed about said support bolt; and said pair of washers being disposed about said support bolt between said first and second nuts, said second metal sleeve being between said pair of washers and engaging each of said pair of washers at a respective end of said second sleeve.

5. A vibration-isolating mounting system for a marine engine and drive gear assembly to be mounted upon a pair of longitudinally extending, generally parallel stringers and upon a crossmember, comprising:

a trunnion mount for mounting a front portion of the engine to the crossmember; and a pair of vibration absorbing assemblies, each assembly configured for mounting the rear of the engine to its respective stringer, each assembly including:

a mounting bracket adapted for attachment to the engine;

a base adapted for attachment to a stringer; and first and second resilient vibration absorbing members supported within said mounting bracket and selectively connected to the base, said first resilient member being relatively more resistant in a horizontal direction for cushioning horizontal thrust loads acting upon said bracket with respect to said base, said first resilient member providing substantially zero resistance to vertical movement of said bracket with respect to said base when no horizontal thrust load is acting upon said bracket with respect to said base, and said second resilient member being relatively more resistant in a vertical direction for cushioning vertical loads upon said bracket with respect to said base.

* * * * *